US011780070B2

(12) United States Patent
Machida et al.

(10) Patent No.: US 11,780,070 B2
(45) Date of Patent: Oct. 10, 2023

(54) ELECTRIC POWER TOOL

(71) Applicant: MAKITA CORPORATION, Anjo (JP)

(72) Inventors: Yoshitaka Machida, Anjo (JP); Hitoshi Iida, Anjo (JP); Taro Hisano, Anjo (JP)

(73) Assignee: MAKITA CORPORATION, Anjo (JP)

( * ) Notice: Subject to any disclaimer, the term of this patent is extended or adjusted under 35 U.S.C. 154(b) by 7 days.

(21) Appl. No.: 17/588,810

(22) Filed: Jan. 31, 2022

(65) Prior Publication Data

US 2022/0266438 A1 Aug. 25, 2022

(30) Foreign Application Priority Data

Feb. 22, 2021 (JP) ..... 2021-026500

(51) Int. Cl.
*B25F 5/00* (2006.01)
*B25D 16/00* (2006.01)

(52) U.S. Cl.
CPC ..... *B25F 5/001* (2013.01); *B25D 16/003* (2013.01); *B25D 2250/165* (2013.01)

(58) Field of Classification Search
CPC ..... B25F 5/001
See application file for complete search history.

(56) References Cited

U.S. PATENT DOCUMENTS 8,684,105 B2 4/2014 Yoshikane et al.
2011/0167651 A1* 7/2011 Tokunaga ..... B23D 47/12 30/388
2011/0259623 A1* 10/2011 Yoshikane ..... B25F 5/001 173/176
2020/0305893 A1* 10/2020 Nino ..... B25F 5/001

FOREIGN PATENT DOCUMENTS

JP 5456555 B2 4/2014

* cited by examiner

*Primary Examiner* — Daniel Jeremy Leeds
(74) *Attorney, Agent, or Firm* — Oliff PLC

(57) ABSTRACT

An electric power tool includes a motor, a driving side member, and a driven side member. The driving side member and the driven side member have mutually opposed surfaces. A plurality of cam teeth are respectively disposed on concentric circles on the opposed surfaces. The plurality of cam teeth have meshing surfaces inclined at predetermined lead angles. A torque limiter is formed to disengage the engagement of the meshing surfaces of the cam teeth by moving the one member in a separation direction from the other member when load of the driven side member increases. The respective cam teeth are formed such that the lead angles of the meshing surfaces are different between a forward rotation side and a reverse rotation side. A transmission torque transmitted from the driving side member to the driven side member is equal between the forward rotation and the reverse rotation.

14 Claims, 7 Drawing Sheets

ELECTRIC POWER TOOL

This application claims the benefit of Japanese Patent Application Number 2021-026500 filed on Feb. 22, 2021, the entirety of which is incorporated by reference.

BACKGROUND OF THE INVENTION

Field of the Invention

The disclosure relates to an electric power tool, such as a hammer drill.

Description of Related Art

An electric power tool, such as a hammer drill, includes a torque transmission mechanism that includes a driving side member rotated by driving of a motor and a driven side member to which a torque is transmitted from the driving side member. Especially, the torque transmission mechanism that includes a torque limiter, which shuts off the torque transmission from the driving side member when an excessive load is applied to the driven side member serving as an output side, has been known.

For example, Japanese Patent No. 5456555 discloses a hammer drill in which gears are respectively disposed to a tool holder that holds a bit and an intermediate shaft parallel to the tool holder to ensure transmission of a rotation of the intermediate shaft to the tool holder via the gears. The gear (the driving side member) on the tool holder side here is externally mounted to be rotatable to the tool holder, and engages with a flange (a driven side member) fixed to the tool holder by mutual cam teeth. The gear forms a torque limiter that is pushed by the flange with a coil spring and transmits the torque to the flange. Accordingly, when an excessive load is applied to the tool holder, against the biasing of the coil spring, the gear moves to a side separated from the flange to disengage the engagement of the cams, thus shutting off the torque transmission.

With the torque limiter as in Japanese Patent No. 5456555, as an amount of backlash between the cam teeth decreases, the rotational rattle during an operation can be reduced. However, with the small amount of backlash, before the cam teeth enter the original engaged state during the operation of the torque limiter, the cam teeth are likely to collide with the next cam teeth. In view of this, sagging (deformation) possibly occurs in the cam teeth.

Therefore, an object of the disclosure is to provide an electric power tool in which sagging is less likely to occur in cam teeth of a torque limiter.

SUMMARY OF THE INVENTION

In order to achieve the above-described object, there is provided an electric power tool according to the disclosure. The electric power tool includes a motor, a driving side member, and a driven side member. The driving side member is rotatable in both of forward and reverse directions by driving of the motor. The driven side member is disposed opposed to the driving side member in an axial direction. The driving side member and the driven side member have mutually opposed surfaces. A respective plurality of cam teeth are disposed on concentric circles on the opposed surfaces. The respective plurality of cam teeth have meshing surfaces inclined at predetermined lead angles. Engagement of the mutual meshing surfaces of the cam teeth in a rotation direction transmits a torque. One member of the driving side member and the driven side member is movably disposed in the axial direction with respect to the other member and is biased to the other member side with an elastic member. A torque limiter is formed to disengage the engagement of the meshing surfaces of the cam teeth by moving the one member in a separation direction from the other member when load of the driven side member increases. The respective cam teeth of the driving side member and the driven side member are formed such that the lead angles of the meshing surfaces are different between a forward rotation side and a reverse rotation side. As a result, transmission torque transmitted from the driving side member to the driven side member is equal between the forward rotation and the reverse rotation.

According to the disclosure, since the lead angles of the meshing surfaces of the cam teeth are different, the cam teeth are less likely to collide with one another during the operation of the torque limiter. Even when the cam teeth collide with one another, the impact is reduced. Accordingly, sagging is less likely to occur in the cam teeth. Further, even if the lead angles are different, the transmission torques are equal, and therefore there is no difference in the rotation transmission in the torque limiter between the forward rotation and the reverse rotation.

DETAILED DESCRIPTION

Figure 1:
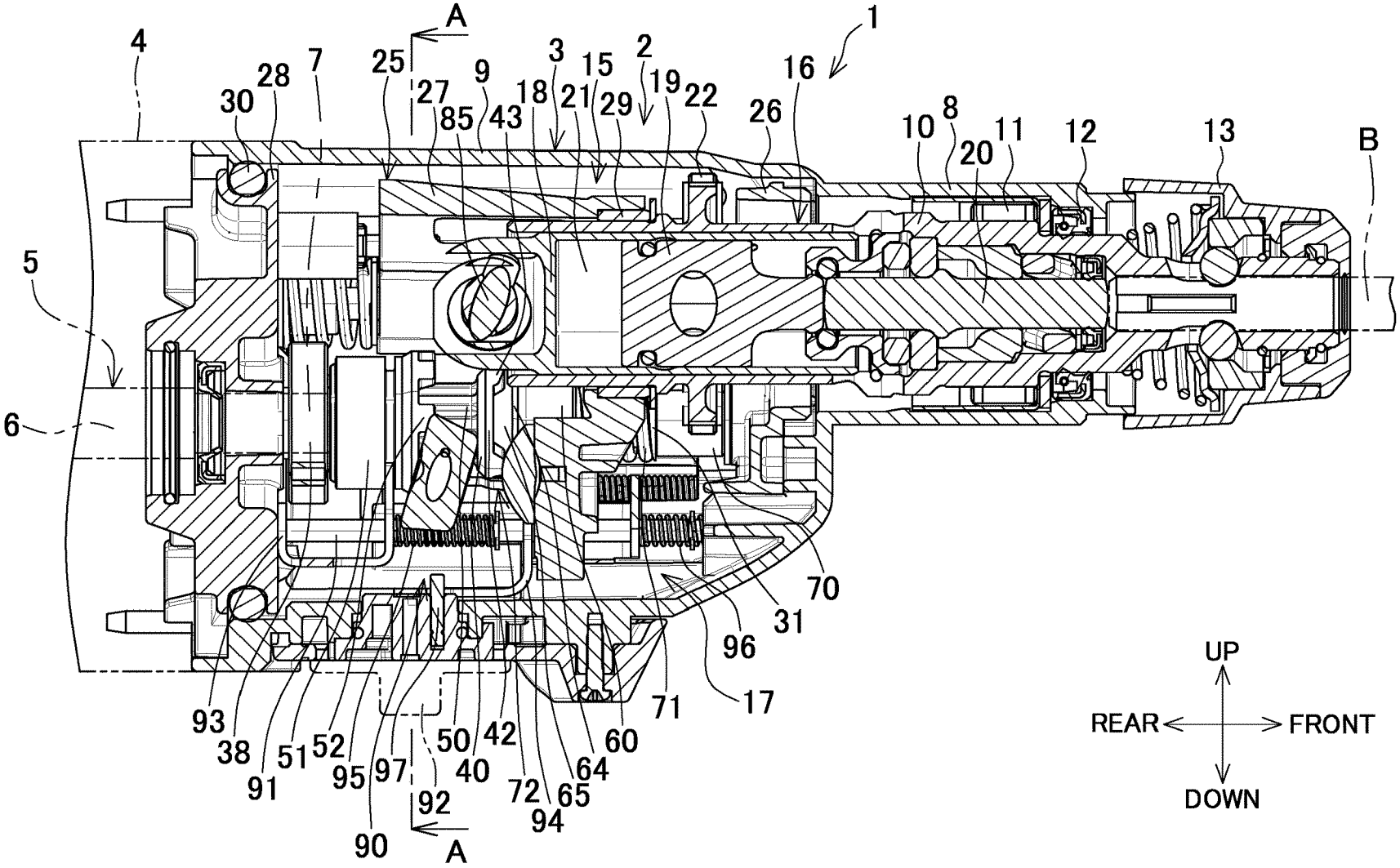
FIG. 1 is a partial center vertical cross-sectional view of a hammer drill.

In one embodiment of the disclosure, the lead angles of meshing surfaces of respective cam teeth on a forward rotation side may be formed smaller than the lead angles of meshing surfaces on a reverse rotation side. Further, the meshing surface on the reverse rotation side of the cam tooth of the other member may be formed to have a lift toward the one member side such that an amount of the lift is smaller than that of the meshing surface on the forward rotation side. With this configuration, collision between the cam teeth during the forward rotation is effectively avoidable. Moreover, even if the lift amount of the meshing surface on the forward rotation side is smaller than that of the meshing surface on the forward rotation side, a transmission torque between the forward rotation and the reverse rotation can be equalized easily.

In one embodiment of the disclosure, a final output shaft on which a bit is mountable to allow a rotation operation of the final output shaft and/or a hammering operation of the bit may be provided. The torque limiter may be disposed on a rotation shaft. The rotation shaft may be disposed in a preceding stage of the final output shaft to transmit the torque from the motor to the final output shaft. With this configuration, the torque limiter in a drill mode and a hammer drill mode is easily applicable in a hammer drill.

In one embodiment of the disclosure, a rotation shaft for rotation transmission to the final output shaft and a rotation shaft for the hammering operation of the bit may be provided. The rotation shaft on which the torque limiter is disposed may be the rotation shaft for the rotation transmission. With this configuration, the torque limiter is easily formed by using the rotation shaft for the rotation transmission.

In one embodiment of the disclosure, the cam tooth of the other member may have a lift toward the one member side such that an amount of the lift decreases by inclining an opposed surface to the one member in a direction of separating from the one member as heading from the forward rotation side toward the reverse rotation side. With this configuration, the cam tooth that climbs on the opposed surface can be smoothly guided to between the cam teeth, and the collision with the next cam tooth can be effectively avoided.

In one embodiment of the disclosure, the inclination of the opposed surface may be formed from a center of the opposed surface in the rotation direction. With this configuration, even when a relief portion formed by the inclination is provided, strength of the cam teeth can be ensured.

In one embodiment of the disclosure, the driving side member and the driven side member may have sleeve shapes externally mounted on the rotation shaft. A grease pool may be disposed to be depressed in at least any one of an inner peripheral surface of the one member and an outer peripheral surface of the rotation shaft. With this configuration, the torque limiter allows stabilizing an operation torque in which the one member moves back and forth.

In one embodiment of the disclosure, the grease pool may be a ring-shaped groove formed in the outer peripheral surface of the rotation shaft. With this configuration, the grease pool that can preferably hold a grease can be easily formed.

In one embodiment of the disclosure, a receiving member and a plurality of washers may be provided. The receiving member may receive the other member pushed by the one member in the axial direction and may be externally and integrally mounted on the rotation shaft in the rotation direction. The plurality of washers may be stacked and interposed between the other member and the receiving member in the axial direction. With this configuration, frictional heat generated between the other member and the receiving member can be reduced. Further, the grease can be preferably held in a sliding surface between the other member and the receiving member.

Hereinafter, the embodiments of the disclosure will be described based on the drawings.

FIG. 1 is a partial center vertical cross-sectional view of a hammer drill as one example of an electric power tool. A hammer drill 1 includes a housing 2 that forms an outer wall. The housing 2 includes an outer housing 3 on the front side, a motor housing 4 at the rear of the outer housing 3, and a handle housing (not illustrated) at the rear of the motor housing 4.

The motor housing 4 is coupled to the outer housing 3 with four screws from the front at four corners in front view. The motor housing 4 houses a motor 5 in a posture with an output shaft 6 facing forward. The output shaft 6 projects to the inside of the outer housing 3 and forms a pinion 7 at the distal end.

In the handle housing, a switch (not illustrated) having a trigger projected forward is housed. The handle housing includes a forward/reverse switching button (not illustrated) to switch a rotation direction of the output shaft 6.

The outer housing 3 includes a front tubular portion 8 and a rear tubular portion 9. The front tubular portion 8 extends forward and has a tubular shape having a circular shape in a transverse cross section. The rear tubular portion 9 has a tubular shape having a diameter larger than that of the front tubular portion 8. The front tubular portion 8 is disposed at an eccentric position on the upper side of the rear tubular portion 9.

A tubular tool holder 10 is coaxially housed in the front tubular portion 8. The tool holder 10 has a front end projecting forward with respect to the front tubular portion 8. At a front end of the front tubular portion 8, a bearing 11 that supports the front portion of the tool holder 10 is held. In front of the bearing 11, an oil seal 12 that seals between the front tubular portion 8 and the tool holder 10 is disposed. At the front end of the tool holder 10 projecting with respect to the front tubular portion 8, an operation sleeve 13 is disposed. The operation sleeve 13 is disposed for an attachment/removal operation of a bit B at the distal end of the tool holder 10.

A driving mechanism 15 is disposed inside the outer housing 3. The driving mechanism 15 includes a rotation/hammering actuation portion 16 and a rotation/hammering switching portion 17 below the rotation/hammering actuation portion 16.

The rotation/hammering actuation portion 16 includes the tool holder 10, a piston cylinder 18, a striker 19, and an impact bolt 20. The piston cylinder 18 has an open front end and is housed to be movable back and forth at the rear portion of the tool holder 10. The striker 19 is housed in the piston cylinder 18 to be movable back and forth via an air chamber 21. The impact bolt 20 is housed in front of the striker 19 to be movable back and forth inside the tool holder 10. The tool holder 10 has a rear portion projecting into the rear tubular portion 9. A gear 22 is disposed on the outer periphery of the tool holder 10 in the rear tubular portion 9.

Figure 2:
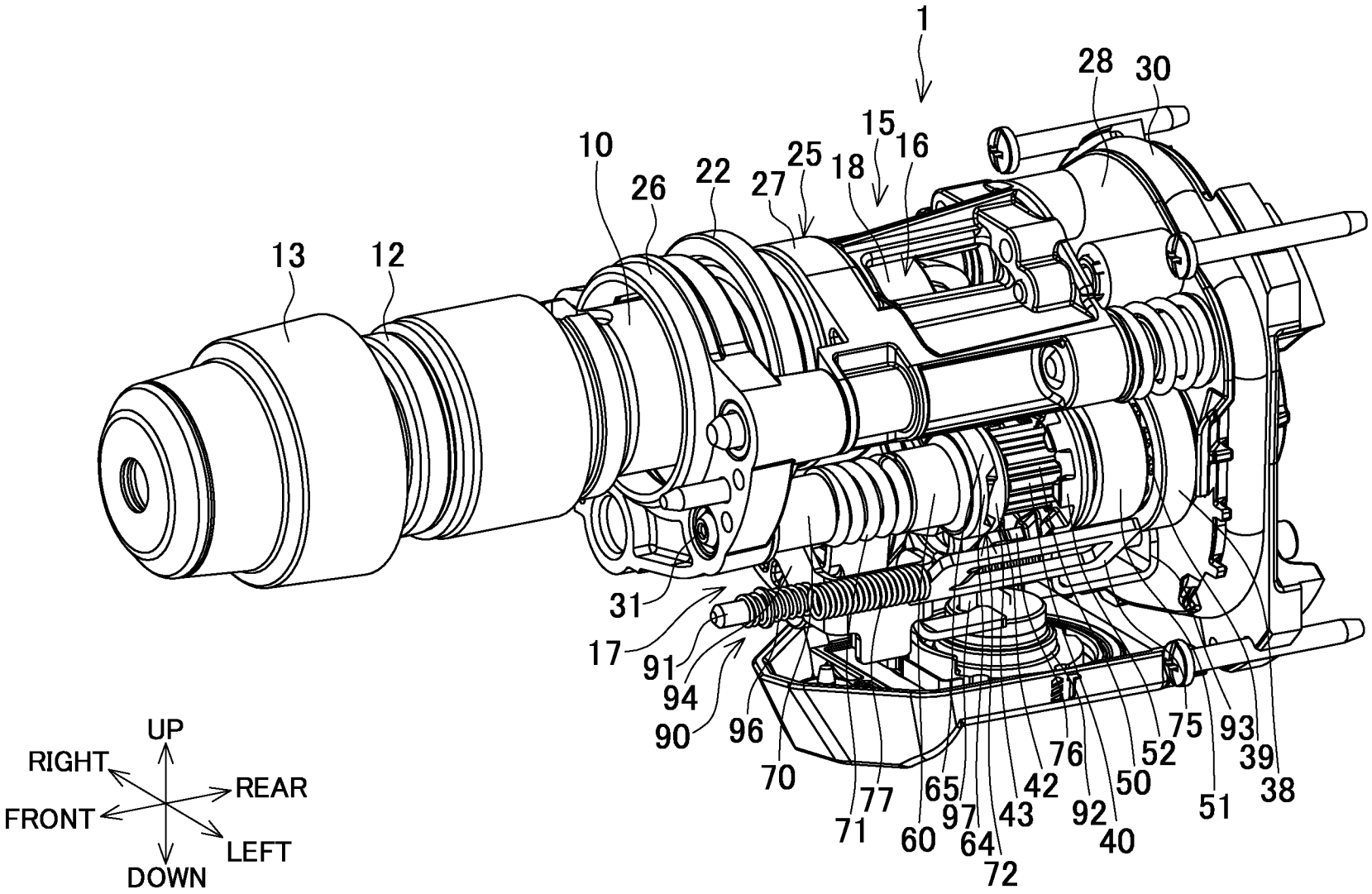
FIG. 2 is a perspective view of a driving mechanism part in which an outer housing is omitted.

An inner housing 25 is housed in the rear tubular portion 9. As illustrated in FIG. 2, the inner housing 25 includes a front plate portion 26, an intermediate portion 27, and a rear plate portion 28. The front plate portion 26 through which the tool holder 10 passes is held inside the rear tubular portion 9. The intermediate portion 27 supports the rear portion of the tool holder 10 via a bearing metal 29. The rear plate portion 28 includes an O-ring 30 on the outer peripheral surface for sealing with the rear tubular portion 9. The rear plate portion 28 supports the output shaft 6.

Figure 3:
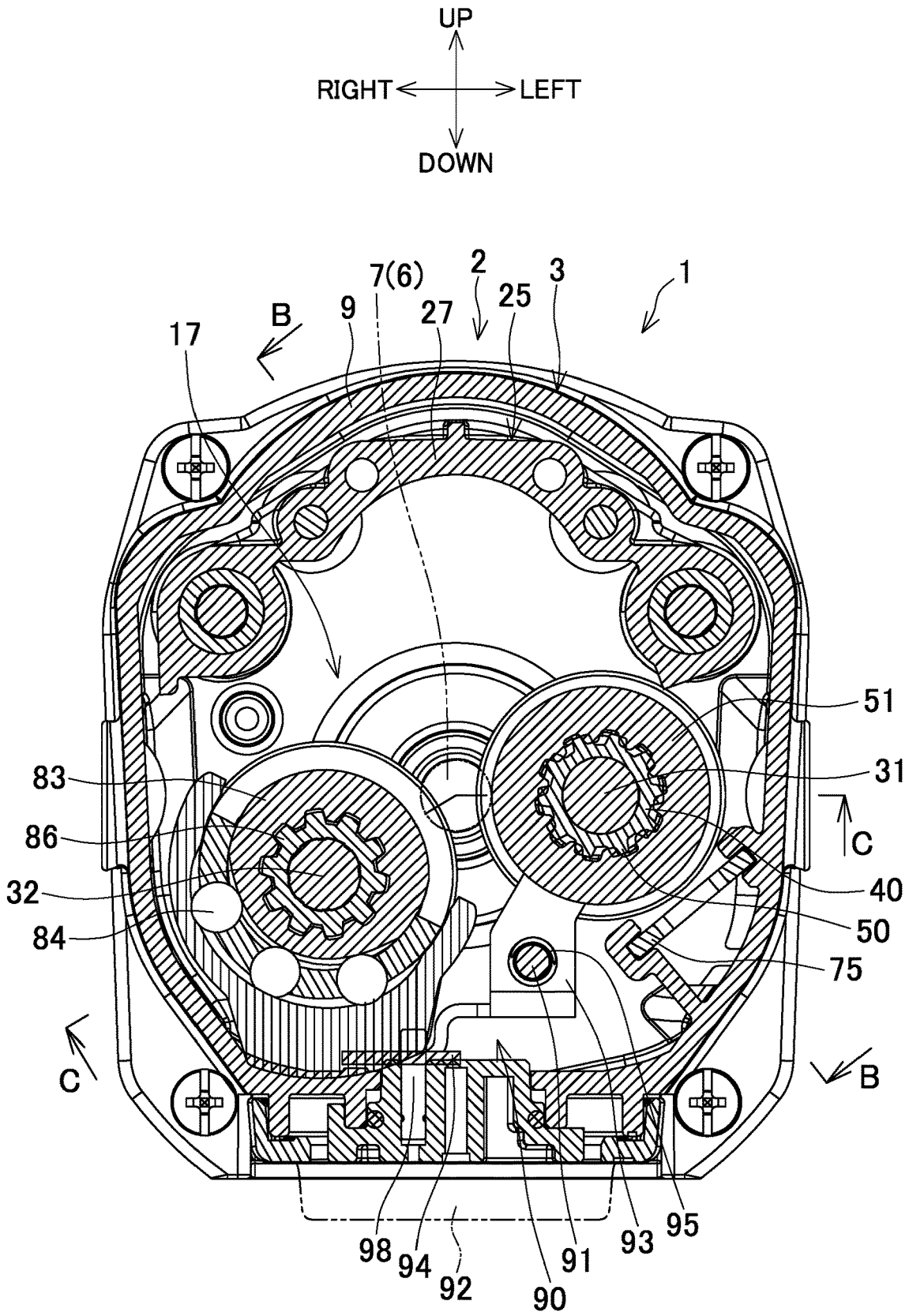
FIG. 3 is a cross-sectional view taken along line A-A in FIG. 1.

The inner housing 25 supports the rotation/hammering switching portion 17. As illustrated in FIG. 3, the rotation/hammering switching portion 17 includes first and second intermediate shafts 31, 32 as two shafts on the right and left on the lower side of the tool holder 10. The first and second intermediate shafts 31, 32 are disposed to be parallel to one another and parallel to the tool holder 10.

Figure 4:
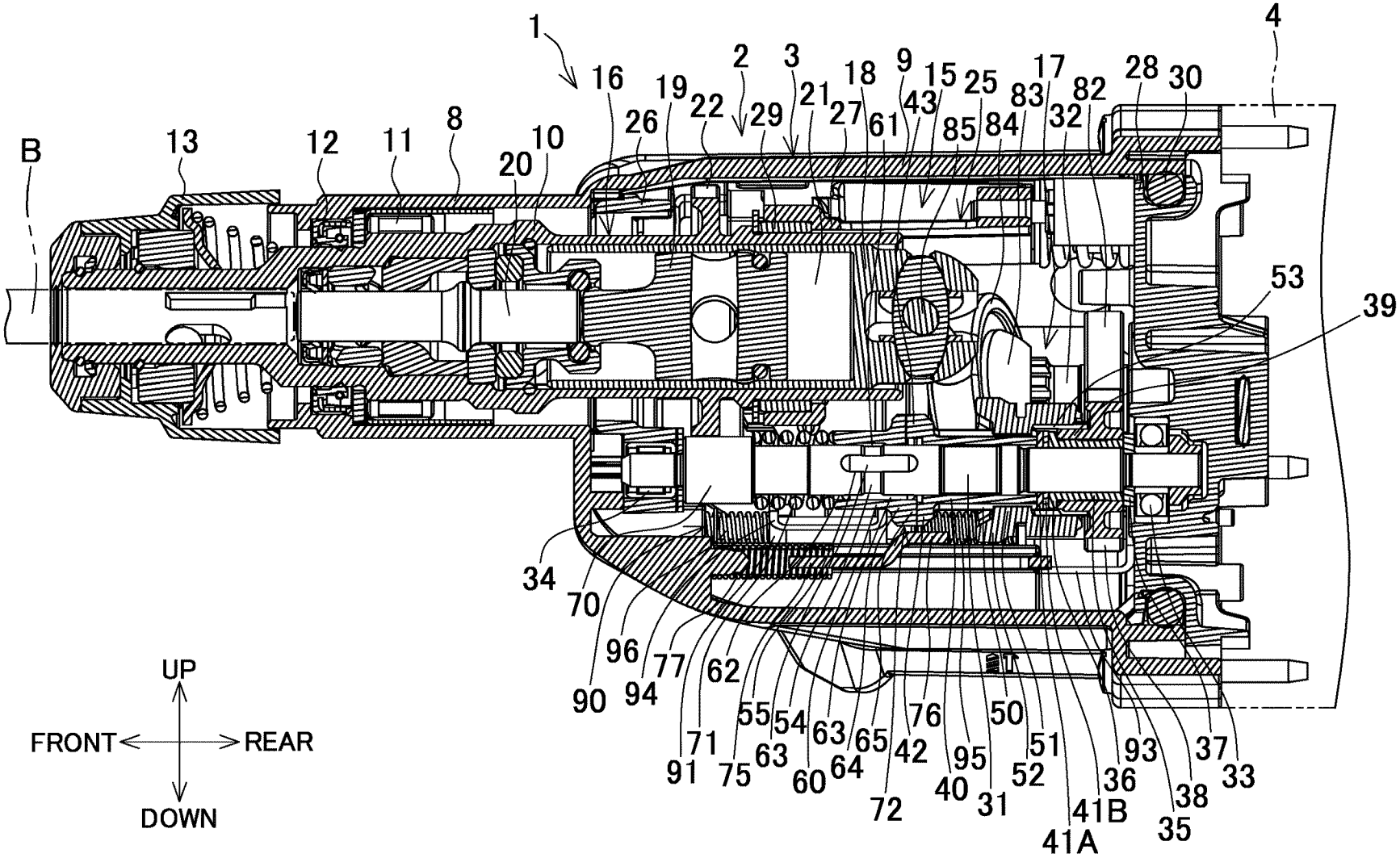
FIG. 4 is a cross-sectional view taken along line B-B in FIG. 3.
Figure 5:
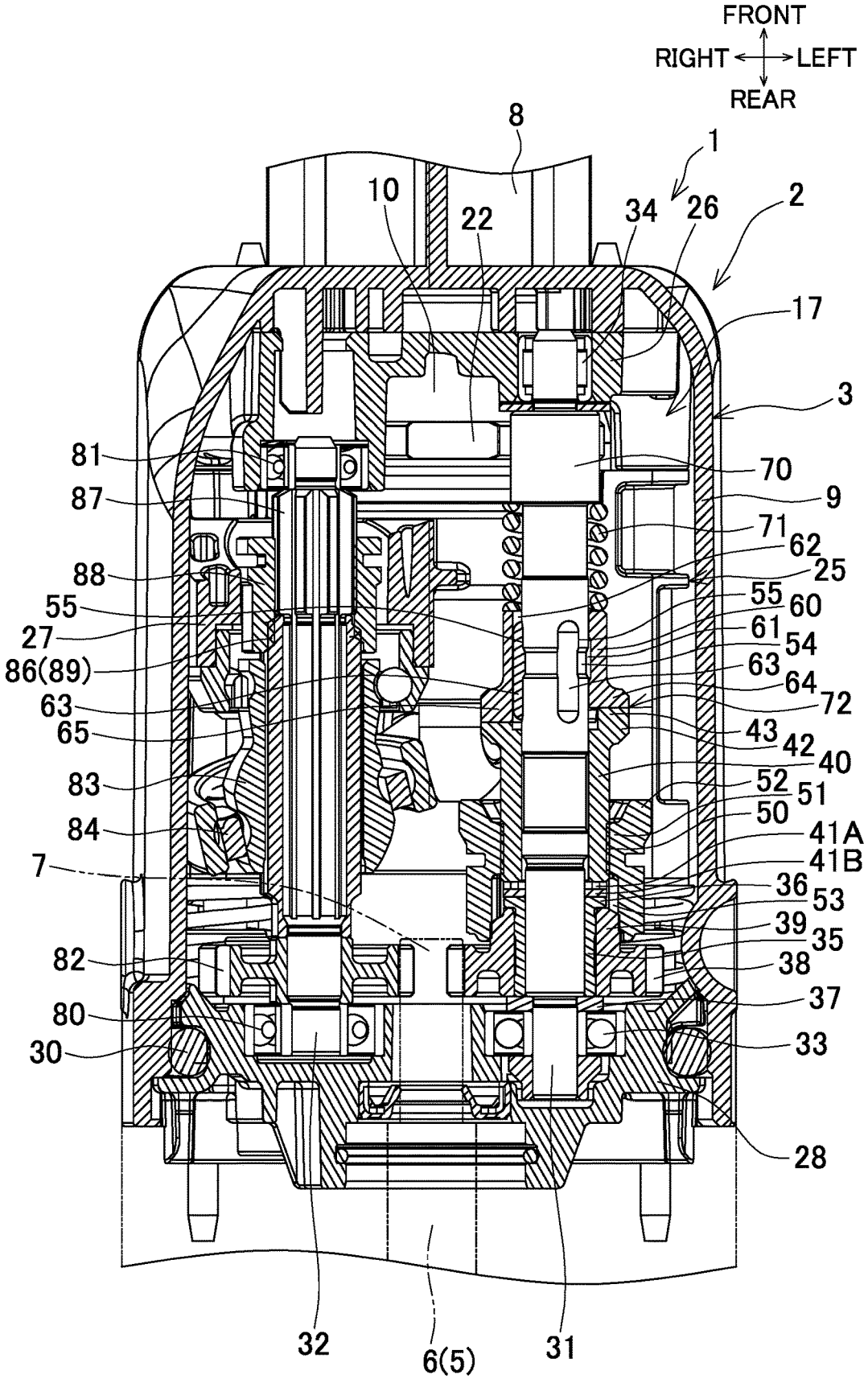
FIG. 5 is a cross-sectional view taken along line C-C in FIG. 3.

As illustrated in FIG. 4 and FIG. 5, the first intermediate shaft 31 on the left side has a rear end rotatably supported to the rear plate portion 28 of the inner housing 25 via a bearing 33. The first intermediate shaft 31 has a front end rotatably supported to the front plate portion 26 of the inner housing 25 via a bearing 34. To the rear portion of the first intermediate shaft 31, a receiving sleeve 35 is externally and integrally mounted by press-fitting. The receiving sleeve 35 includes a flange 36 at the front end. Between the receiving sleeve 35 and the bearing 33, a washer 37 is interposed.

A first gear 38 is externally mounted on the receiving sleeve 35. The first gear 38 meshes with the pinion 7 of the output shaft 6 to rotate separately from the receiving sleeve 35. On the front portion of the first gear 38, a gear side engaging portion 39 formed of a plurality of teeth extending in the front-rear direction is disposed.

On the front side of the receiving sleeve 35 and on the first intermediate shaft 31, a driving side sleeve 40 is externally mounted. The driving side sleeve 40 is separated from the first intermediate shaft 31 and is disposed to be rotatable and movable in the axial direction. Between the receiving sleeve 35 and the driving side sleeve 40 and on the first intermediate shaft 31, two washers 41A, 41B are externally mounted to be stacked in the axial direction. The washer 41A on the front side abuts on the rear end of the driving side sleeve 40. The washer 41B on the rear side abuts on the flange 36 of the receiving sleeve 35.

On the front portion of the driving side sleeve 40, a driving side cam portion 42 is disposed. The driving side cam portion 42 has a ring shape and includes three cam teeth 43, 43 . . . on the front surface that are disposed on a concentric circle of the driving side cam portion 42 and project forward.

Figure 6A:
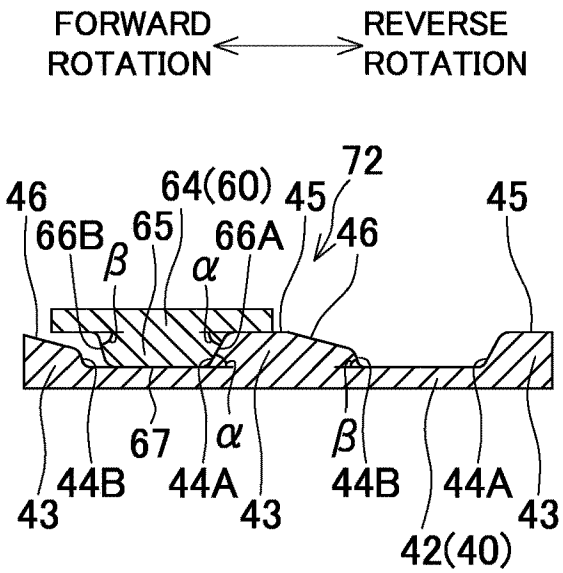
FIG. 6A to FIG. 6C are explanatory diagrams of a torque limiter illustrating a part of developed driving side cam portion and driven side cam portion.

FIG. 6A is a partial development diagram of the driving side cam portion 42. The cam tooth 43 includes meshing surfaces 44A, 44B at the front and the rear in the circumferential direction, extends in the radial direction of the driving side cam portion 42, and has a trapezoidal shape in the transverse cross section. The meshing surface 44A is on the forward rotation (counterclockwise to the front) side, and the meshing surface 44B is on the reverse rotation side. The cam tooth 43 has an opposed surface 45 to a driven side sleeve 60, which will be described later, that is an inclined planar surface gradually inclined to lower from the center in the circumferential direction toward the reverse rotation side. Accordingly, a relief portion 46 having a notch shape is formed on the meshing surface 44B side of the opposed surface 45. Thus, regarding the amounts of lift (amounts of standing to the driven side sleeve 60 side) of the meshing surfaces 44A, 44B, the meshing surface 44B is smaller than the meshing surface 44A.

Further, regarding the lead angle (the angle with respect to a surface perpendicular to the axis line of the driving side cam portion 42), a lead angle $\alpha$ of the meshing surface 44A is smaller than a lead angle $\beta$ of the meshing surface 44B.

On the rear side of the driving side cam portion 42 and on the outer periphery of the driving side sleeve 40, a first spline portion 50 is formed.

To the first spline portion 50, a first clutch 51 is coupled with a spline. The first clutch 51 is disposed to be integrally rotatable with the driving side sleeve 40 and movable back and forth. The first clutch 51 includes a front engaging portion 52 formed of a plurality of pawls. The first clutch 51 includes a rear engaging portion 53 formed of a plurality of teeth extending in the front-rear direction. The rear engaging portion 53 of the first clutch 51 is engageable with the gear side engaging portion 39 of the first gear 38 at the retreated position of the first clutch 51. Accordingly, the rotation of the first gear 38 is transmitted to the driving side sleeve 40 via the first clutch 51.

A ring-shaped inner groove 54 is formed in front of the driving side sleeve 40 and on the outer peripheral surface of the first intermediate shaft 31. Three inner fitted grooves 55, 55 . . . are formed on the outer peripheral surface of the first intermediate shaft 31 at the position of the inner groove 54. The inner fitted grooves 55 intersect with the inner groove 54, extend in the front-rear direction, and are formed at regular intervals in the circumferential direction of the first intermediate shaft 31.

The driven side sleeve 60 is externally mounted at the positions of the inner groove 54 and the inner fitted grooves 55 and on the first intermediate shaft 31. A ring-shaped outer groove 61 is formed on the inner peripheral surface of the driven side sleeve 60. The outer groove 61 has a front-rear width approximately same as that of the inner groove 54 of the first intermediate shaft 31. On the inner peripheral surface of the driven side sleeve 60, three outer fitted grooves 62, 62 . . . are formed. The outer fitted grooves 62 intersect with the outer groove 61, extend in the front-rear direction, and are formed at regular intervals in the circumferential direction of the driven side sleeve 60. The outer fitted grooves 62 are formed across the whole length of the driven side sleeve 60.

Between the inner fitted grooves 55 of the first intermediate shaft 31 and the outer fitted grooves 62 of the driven side sleeve 60, three pins 63, 63 . . . are fitted across both sides. With the pins 63, the driven side sleeve 60 is coupled integrally with the first intermediate shaft 31 in the rotation direction and to be movable separately from the first intermediate shaft 31 in the front-rear direction.

On the rear portion of the driven side sleeve 60, a driven side cam portion 64 is disposed. The driven side cam portion 64 has a ring shape and includes three cam teeth 65, 65 . . . on the rear surface that are disposed on a concentric circle of the driven side cam portion 64 and project rearward.

As illustrated in FIG. 6A, the cam tooth 65 includes meshing surfaces 66A, 66B at the front and the rear in the circumferential direction, extends in the radial direction of the driven side cam portion 64, and has a trapezoidal shape in the transverse cross section. The meshing surface 66A is on the forward rotation side, and the meshing surface 66B is on the reverse rotation side. It should be noted that the cam tooth 65 has a flat opposed surface 67 to the driving side sleeve 40. Lead angles $\alpha$, $\beta$ of the meshing surfaces 66A, 66B are formed at angles same as lead angles $\alpha$, $\beta$ of the meshing surfaces 44A, 44B of the driving side cam portion 42 of the driving side sleeve 40. That is, the lead angle $\alpha$ of the meshing surface 66A is smaller than the lead angle $\beta$ of the meshing surface 66B.

A second gear 70 is formed on the front portion of the first intermediate shaft 31. The second gear 70 meshes with the gear 22 of the tool holder 10. Between the driven side sleeve 60 and the second gear 70 and on the first intermediate shaft 31, a coil spring 71 is externally mounted. The driven side sleeve 60 is biased to a retreated position with the coil spring 71. At the retreated position, the driven side cam portion 64 abuts on the driving side cam portion 42, and the cam teeth 43, 65 engage with one another in the rotation direction. That is, a torque limiter 72 in which the driving side cam portion 42 engages with the driven side cam portion 64 in the rotation direction by the biasing force of the coil spring 71 is formed.

Accordingly, at the retreated position of the first clutch 51, the rotation of the first gear 38 is transmitted to the driving side sleeve 40 via the first clutch 51. The rotation of the driving side sleeve 40 is transmitted to the driven side sleeve 60 by the engagement of the driving side cam portion 42 and the driven side cam portion 64. The rotation of the driven side sleeve 60 is transmitted to the first intermediate shaft 31 via the pins 63. Accordingly, the second gear 70 rotates to rotate the tool holder 10 via the gear 22.

At the retreated position of the driven side sleeve 60, the outer groove 61 of the driven side sleeve 60 overlaps with the inner groove 54 of the first intermediate shaft 31 in the radial direction. Accordingly, a part between both grooves 61, 54 serves as a grease pool.

Figure 6B:
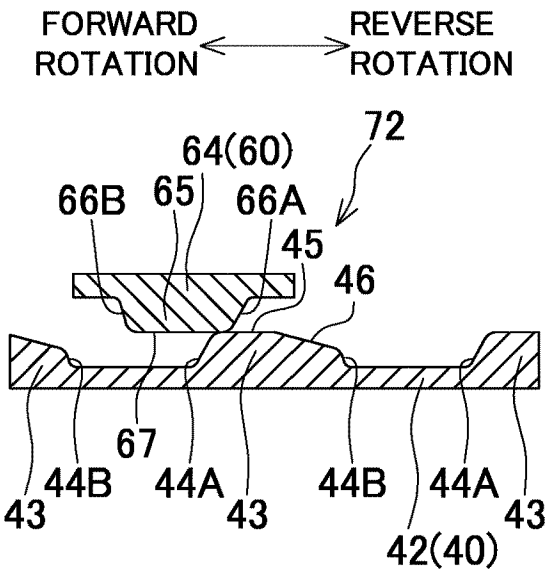
Figure 6C:
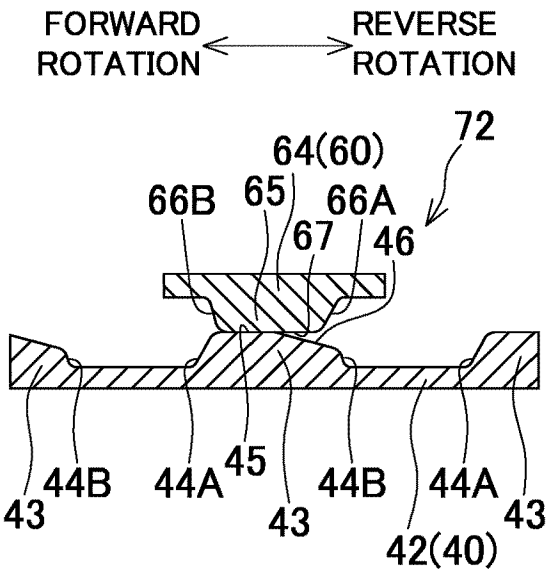
Figure 7A:
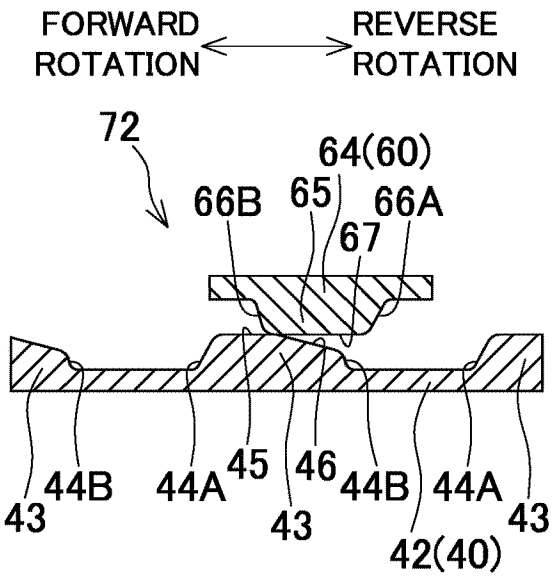
FIG. 7A to FIG. 7C are explanatory diagrams of the torque limiter illustrating a part of the developed driving side cam portion and driven side cam portion.
Figure 7B:
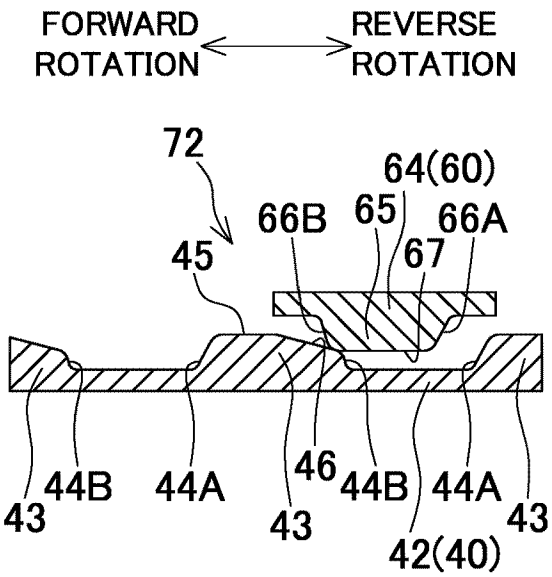
Figure 7C:
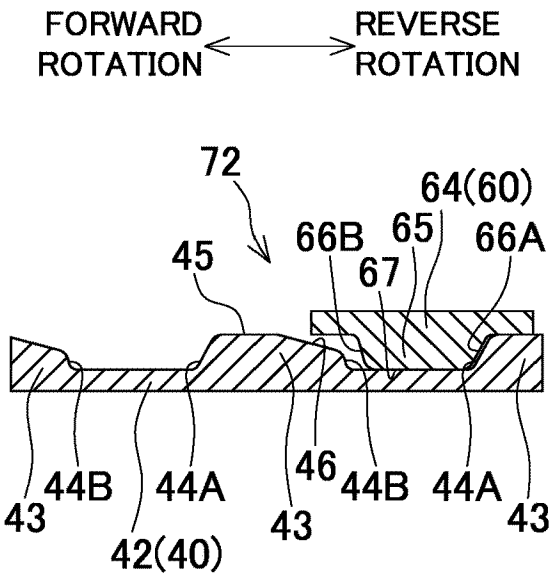

In the torque limiter 72, when, for example, the bit B is unintentionally locked, a load exceeding the biasing force of the coil spring 71 is applied from the tool holder 10 side to the driven side sleeve 60. Then, in the forward rotation, as illustrated in FIG. 6B, the driven side cam portion 64 (the driven side sleeve 60) moves relative to the driving side cam portion 42 with a guide of the mutual meshing surfaces 44A, 66A of the cam teeth 43, 65, and the cam tooth 65 climbs on the cam tooth 43. Since the driving side cam portion 42 (the driving side sleeve 40) continues the rotation as is, as illustrated in FIG. 6C, the cam tooth 65 relatively moves in the circumferential direction on the opposed surface 45 of the cam tooth 43. When the cam tooth 65 reaches the relief portion 46, as illustrated in FIG. 7A and FIG. 7B, the cam tooth 65 relatively moves in the circumferential direction while retreating along the relief portion 46 by the biasing of the coil spring 71. Accordingly, the cam tooth 65 relatively climbs over the cam tooth 43 and engages with the next cam tooth 43 adjacent in the circumferential direction again as illustrated in FIG. 7C. Since the cam tooth 65 retreats along the relief portion 46, the cam tooth 65 can be fitted between the cam teeth 43, 43 without colliding with the next cam tooth 43 and engaged again.

Through the repetition of climbing over and the re-engagement of the mutual cam teeth 43, 65, the driving side sleeve 40 idles to the driven side sleeve 60. Accordingly, the rotation transmission to the driven side sleeve 60 and the first intermediate shaft 31 is shut off.

On the other hand, when the first clutch 51 moves forward to a first advance position, the first clutch 51 separates from the first gear 38. Thus, the rotation of the first gear 38 is not transmitted to the driving side sleeve 40. Therefore, the torque is not transmitted to the driven side sleeve 60 engaging with the driving side sleeve 40 or not transmitted to the first intermediate shaft 31.

On the lower left side of the first intermediate shaft 31, a lock plate 75 is disposed. The lock plate 75 includes a lock pawl 76 facing rearward. A coil spring 77 is disposed on the front side of the lock plate 75. When the first clutch 51 moves forward up to a second advance position forward of the first advance position, the lock pawl 76 engages with the front engaging portion 52 of the first clutch 51. Thus, the rotations of the first clutch 51 and the driving side sleeve 40 are locked. Therefore, the rotations of the first intermediate shaft 31 and the tool holder 10 are locked via the driven side sleeve 60 engaging with the driving side sleeve 40.

As illustrated in FIG. 5, the second intermediate shaft 32 on the right side has a rear end rotatably supported to the rear plate portion 28 of the inner housing 25 via a bearing 80. The second intermediate shaft 32 has a front end rotatably supported to the front plate portion 26 via a bearing 81. A third gear 82 meshing with the pinion 7 of the output shaft 6 is fixed to the rear portion of the second intermediate shaft 32 such that the third gear 82 is integrally rotatable with the second intermediate shaft 32. In front of the third gear 82 and on the second intermediate shaft 32, a boss sleeve 83 is externally mounted to be rotatable separately. The boss sleeve 83 includes a swash bearing 84 whose axis line is inclined. An arm 85 is disposed to protrude upward on an outer race of the swash bearing 84. The arm 85 has a distal end coupled to the rear end of the piston cylinder 18. On the inner periphery of the boss sleeve 83, a boss side engaging pipe 86 having a plurality of teeth extending in the front-rear direction is integrally coupled.

In front of the boss sleeve 83 and on the second intermediate shaft 32, a second spline portion 87 is formed. To the second spline portion 87, a second clutch 88 is coupled with a spline. The second clutch 88 includes a clutch side engaging portion 89 disposed to be integrally rotatable with the second intermediate shaft 32 and movable back and forth. The second clutch 88 is formed of a plurality of teeth extending in the front-rear direction at the rear portion. At the retreated position of the second clutch 88, the clutch side engaging portion 89 engages with the boss side engaging pipe 86 of the boss sleeve 83. Accordingly, the rotation of the second intermediate shaft 32 is transmitted to the boss sleeve 83 via the second clutch 88. When the second clutch 88 moves forward, the clutch side engaging portion 89 separates from the boss side engaging pipe 86 and the rotation of the second intermediate shaft 32 is not transmitted to the boss sleeve 83.

As illustrated in FIG. 1 to FIG. 4, a mode switching mechanism 90 is disposed below the first and second intermediate shafts 31, 32. The mode switching mechanism 90 includes a rod 91 and a switching knob 92.

The rod 91 is disposed parallel to the first and second intermediate shafts 31, 32. The rod 91 has a rear end supported to the rear plate portion 28 and a front end supported to the rear tubular portion 9. The rod 91 includes first and second plates 93, 94 to be movable back and forth. The first plate 93 is passed through by the rod 91 at the rear portion of the rod 91. The second plate 94 is passed through by the rod 91 at the front portion of the rod 91. The first plate 93 has a front end engaged with the outer periphery of the first clutch 51. The second plate 94 has a front end engaged with the outer periphery of the second clutch 88. In front of the first plate 93 and on the rod 91, a first coil spring 95 is externally mounted. In front of the second plate 94 and on the rod 91, a second coil spring 96 is externally mounted. The first coil spring 95 biases the first plate 93 to a retreated position where the first plate 93 abuts on the front surface of the rear plate portion 28. This retreated position is equal to the retreated position of the first clutch 51 that retreats together with the first plate 93. The second coil spring 96 biases the second plate 94 to a retreated position where the second plate 94 abuts on a second eccentric pin 98 described later. This retreated position is equal to the retreated position of the second clutch 88 that retreats together with the second plate 94.

The positions of the first and second plates 93, 94 are changeable with the switching knob 92. The switching knob 92 with which a rotation operation can be performed is disposed on the lower surface of the rear tubular portion 9. The switching knob 92 includes first and second eccentric pins 97, 98 projecting inside the rear tubular portion 9. The first eccentric pin 97 engages with the first plate 93 from the rear, and the second eccentric pin 98 engages with the second plate 94 from the rear.

Accordingly, by performing the rotation operation with the switching knob 92, the front-rear positions of the first and second plates 93, 94 (the first and second clutches 51, 88) can be switched via the first and second eccentric pins 97, 98. That is, an operation mode can be switched between the drill mode, the hammer drill mode, a hammer mode (a rotation lock), and a hammer mode (neutral).

In the drill mode, the first clutch 51 is at the retreated position and the second clutch 88 is at the advance position. Accordingly, the rotation of the first gear 38 can be transmitted to the tool holder 10. On the other hand, the rotation of the third gear 82 and the second intermediate shaft 32 cannot be transmitted to the boss sleeve 83. Accordingly, when the motor 5 drives and the output shaft 6 rotates, only the rotation of the bit B together with the tool holder 10 is performed.

In the hammer drill mode, both of the first clutch 51 and the second clutch 88 are at the retreated positions. Accordingly, the rotation of the first gear 38 can be transmitted to the tool holder 10. Meanwhile, the rotations of the third gear 82 and the second intermediate shaft 32 can also be transmitted to the boss sleeve 83. Accordingly, when the output shaft 6 rotates, the bit B rotates and the boss sleeve 83 rotates, thus swinging the arm 85 back and forth. Therefore, the piston cylinder 18 reciprocates to reciprocate the striker 19 and hammer the bit B via the impact bolt 20.

In the hammer mode (the rotation lock), the first clutch 51 is at the second advance position, and the second clutch 88 is at the retreated position. Accordingly, the rotation of the first gear 38 cannot be transmitted to the tool holder 10. It should be noted that, since the first clutch 51 engages with the lock plate 75, the rotation of the tool holder 10 is locked. On the other hand, the rotations of the third gear 82 and the second intermediate shaft 32 can be transmitted to the boss sleeve 83. Accordingly, when the output shaft 6 rotates, the boss sleeve 83 rotates to swing the arm 85 back and forth while the bit B is fixed around the axis line and does not rotate. Therefore, only the hammering operation of the bit B is performed.

In the hammer mode (neutral), the first clutch 51 is at the first advance position and the second clutch 88 is at the retreated position. Accordingly, the rotation of the first gear 38 cannot be transmitted to the tool holder 10. It should be noted that, since the first clutch 51 does not engage with the lock plate 75, the rotation of the tool holder 10 is released from the lock. On the other hand, the rotations of the third gear 82 and the second intermediate shaft 32 can be transmitted to the boss sleeve 83. Accordingly, when the output shaft 6 rotates, the boss sleeve 83 rotates to swing the arm 85 back and forth while the bit B does not rotate. Therefore, only the hammering operation of the bit B is performed.

Thus, at the operation in the drill mode or the hammer drill mode, in the torque limiter 72 in both of the forward and reverse rotations of the motor 5, the torque is transmitted by the mutual meshing between the cam teeth 43, 65 of the driving side cam portion 42 of the driving side sleeve 40 and the driven side cam portion 64 of the driven side sleeve 60. Here, while the lift amount of the meshing surface 44B on the reverse rotation side is smaller than that of the meshing surface 44A on the forward rotation side by the relief portion 46 being formed on the cam tooth 43 of the driving side cam portion 42, the lead angle β of the meshing surface 44B is larger than the lead angle α of the meshing surface 44A. Therefore, the transmission torque becomes equal between the forward rotation and the reverse rotation.

In the torque limiter 72, when, for example, the bit B is unintentionally locked, a load exceeding the biasing force of the coil spring 71 is applied from the tool holder 10 side to the driven side sleeve 60, and the driven side sleeve 60 moves back and forth. Accordingly, the cam tooth 65 of the driven side cam portion 64 is repeatedly engaged with/disengaged from the cam tooth 43 of the driving side cam portion 42. As a result, the driving side sleeve 40 idles and the rotation transmission to the driven side sleeve 60 is shut off. At this time, since the cam tooth 65 of the driven side cam portion 64 engages with the cam tooth 43 of the driving side cam portion 42 again without a collision, sagging is less likely to occur in the cam teeth 43, 65.

The hammer drill 1 having the above-described configuration (the electric power tool) includes the motor 5, the driving side sleeve 40 (one example of the driving side member) rotatable in both of the forward and reverse directions by driving of the motor 5, and the driven side sleeve 60 (one example of the driven side member) disposed opposed to the driving side sleeve 40 in the axial direction. The driving side sleeve 40 and the driven side sleeve 60 have the mutually opposed surfaces. The respective plurality of cam teeth 43, 65 are disposed on the concentric circles on the opposed surfaces and have the meshing surfaces 44A, 44B and 66A, 66B inclined at the predetermined lead angles α, β. The engagement of the meshing surfaces 44A, 44B and 66A, 66B of the cam teeth 43, 65 in the rotation direction transmits the torque. Further, the driven side sleeve 60 is movably disposed in the axial direction with respect to the driving side sleeve 40 and is biased to the driving side sleeve 40 side with the coil spring 71 (one example of the elastic member), and the torque limiter 72 is formed when load of the driven side member 60 increases. The torque limiter 72 disengages the engagement of the meshing surfaces 44A, 44B and 66A, 66B of the cam teeth 43, 65 by moving the driven side sleeve 60 in the separation direction from the driving side sleeve 40. In the respective cam teeth 43, 65 of the driving side sleeve 40 and the driven side sleeve 60, the lead angles α, β of the meshing surfaces 44A, 44B and 66A, 66B are formed to be different between the forward rotation side and the reverse rotation side. The transmission torque transmitted from the driving side sleeve 40 to the driven side sleeve 60 is equal between the forward rotation and the reverse rotation.

According to this configuration, since the lead angles α, β of meshing surfaces 44A, 44B and 66A, 66B of cam teeth 43, 65 are different, the cam teeth 43, 65 are less likely to collide with one another during the operation of the torque limiter 72. Even when the cam teeth 43, 65 collide with one another, an impact is reduced. Accordingly, sagging is less likely to occur in the cam teeth 43, 65. Further, even though the lead angles α, β are different between the forward rotation and the reverse rotation, the transmission torques are equal. Therefore, there is no difference in the rotation transmission in the torque limiter 72 between the forward rotation and the reverse rotation.

The lead angles α, β of the meshing surfaces 44A, 66A of the respective cam teeth 43, 65 on the forward rotation side are formed smaller than those of the meshing surfaces 44B, 66B on the reverse rotation side. Further, the meshing surface 44B on the reverse rotation side of the cam tooth 43 of the driving side sleeve 40 is formed to have the lift toward the driven side sleeve 60 side such that the lift amount is smaller than that of the meshing surface 44A on the forward rotation side. Accordingly, the collision between the cam teeth 43, 65 during the forward rotation is effectively avoidable. Moreover, even if the lift amount of the meshing surface 44B is smaller, the transmission torque between the forward rotation and the reverse rotation can be equalized easily.

In the hammer drill 1, the tool holder 10 (one example of the final output shaft) on which the bit B is mountable is provided, and the rotation operation of the tool holder 10 and/or the hammering operation of the bit B is performed. The torque limiter 72 is disposed on the first intermediate shaft 31 (one example of the rotation shaft) that is disposed on the preceding stage of the tool holder 10 to transmit the torque from the motor 5 to the tool holder 10. Accordingly, the torque limiter 72 in the drill mode and the hammer drill mode in the hammer drill 1 is easily applicable.

The first intermediate shaft 31 (an example of the rotation shaft) for the rotation transmission to the tool holder 10 and the second intermediate shaft 32 (an example of the rotation shaft) for the hammering operation of the bit B are also provided in the hammer drill 1. The rotation shaft on which the torque limiter 72 is disposed is the first intermediate shaft 31 for the rotation transmission. Accordingly, the torque limiter 72 can be easily formed by using the first intermediate shaft 31.

The amount of the lift toward the driven side sleeve 60 side in the cam tooth 43 of the driving side sleeve 40 decreases by inclining the opposed surface 45 to the driven side sleeve 60 in the direction of separating from the driven side sleeve 60 as heading from the forward rotation side toward the reverse rotation side. Accordingly, the cam tooth 65 that climbs on the opposed surface 45 can be smoothly guided to between the cam teeth 43, 43, and the collision with the next cam tooth 43 is effectively avoidable.

The inclination of the opposed surface 45 is formed from the center in the rotation direction. Accordingly, even when the relief portion 46 formed by the inclination is provided, strength of the cam teeth 43 can be ensured.

The driving side sleeve 40 and the driven side sleeve 60 have the sleeve shapes externally mounted on the first intermediate shaft 31, and the inner groove 54 and the outer groove 61 as the grease pools are disposed to be depressed in the inner peripheral surface of the driven side sleeve 60 and the outer peripheral surface of the first intermediate shaft 31. Accordingly, the torque limiter 72 allows stabilizing the operation torque in which the driven side sleeve 60 moves back and forth.

The grease pool is the ring-shaped inner groove 54 (one example of the groove) formed in the outer peripheral surface of the first intermediate shaft 31. Accordingly, the grease pool that can preferably hold the grease can be easily formed.

The receiving sleeve 35 (one example of the receiving member) that receives the driving side sleeve 40 pushed by the driven side sleeve 60 in the axial direction is externally and integrally mounted on the first intermediate shaft 31 in the rotation direction. The two washers 41A, 41B are stacked and interposed between the driving side sleeve 40 and the receiving sleeve 35 in the axial direction. Accordingly, frictional heat generated between the driving side sleeve 40 and the receiving sleeve 35 can be reduced. Further, the grease can be preferably held in the sliding surface between the driving side sleeve 40 and the first intermediate shaft 31.

The following will describe modification examples.

The relief portion disposed on the cam tooth is not limited to one formed of the inclined planar surface. The relief portion can be formed of an inclined curved surface (including a depressed curved surface and a convex curved surface), or can be formed of a depressed notch.

The numbers of the cam teeth of the respective driving side cam portion and driven side cam portion can be increased and decreased.

While the cam tooth on which the relief portion is formed is disposed on the driving side cam portion in the above-described configuration, the cam tooth on which the relief portion is formed may be disposed on the driven side cam portion.

It should be noted that only changing the lead angle of the meshing surface without forming the relief portion on the cam tooth can also inhibit the sagging in the cam tooth. For example, only by forming the lead angle of the meshing surface on the forward rotation side smaller than that of the reverse rotation side, the cam teeth are less likely to collide with one another at the operation of the torque limiter during the forward rotation. Even when the cam teeth collide, the impact is reduced.

Moreover, even if the relief portion on the cam tooth is not formed, for example, mechanically changing the compression amount of the coil spring of the torque limiter at the forward rotation and at the reverse rotation can equalize the transmission torque between the forward rotation and the reverse rotation.

The rotation stopper of the driven side sleeve is not limited to the pins. A keyed joint and spline coupling are also employable.

In the above-described configuration, the grease pools are formed by the grooves provided in the respective driven side sleeve and first intermediate shaft, but the grease pool may be the groove disposed in any one of them. A width of the groove is also changeable. A plurality of the grooves can also be disposed.

While the driven side sleeve is disposed to be movable back and forth and engaged with/disengaged from the driving side sleeve in the above-described configuration, the configuration may be the opposite. That is, the driving side sleeve may be disposed to be movable back and forth and engaged with/disengaged from the driven side sleeve.

The driving side member and the driven side member are not limited to the sleeve shapes. The elastic member is not limited to the coil spring but a disc spring, for example, is also employable.

In the above-described configuration, the two intermediate shafts are provided and the torque limiter is disposed on one of them, but in a case where one intermediate shaft is provided, the torque limiter may be disposed on the intermediate shaft.

Further, the torque limiter is not limited to the case of being disposed on the intermediate shaft (the rotation shaft) on the preceding stage of the tool holder. For example, there may be a case where the gear disposed on the tool holder is configured as the driving side member separated from the tool holder, the driven side member is integrally disposed on the tool holder, and the gear is biased to the driven side member with, for example, a coil spring to form the torque limiter. This disclosure is applicable to the torque limiter as well.

Besides, the direction of the motor is not limited to the front-rear direction but can be changed as necessary.

The motor is not limited to a brushed motor but a brushless motor is also employable.

The power supply is not limited to a commercial power supply but may be a battery pack.

A structure for the hammering operation is not limited to the piston cylinder but may be a structure in which a piston reciprocates in a fixed cylinder. A structure without the impact bolt in which the striker directly hammers the bit may be employed. A structure in which a crank mechanism is provided and the rotation of the motor is transformed into reciprocation of, for example, a piston cylinder may be employed.

The disclosure is not limited to the hammer drill. Insofar as a mechanical torque limiter is provided, the disclosure is applicable to other electric power tools like a fastener tool, such as a driver drill and a screwdriver.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool comprising:

a motor;

a driving side member rotatable in both a forward direction and a reverse direction by driving of the motor; and a driven side member opposed to the driving side member in an axial direction, wherein the driving side member has a first opposing surface and the driven side member has a second opposing surface, the first opposing surface and the second opposing surface directly oppose each other, the driving side member includes a first plurality of cam teeth circumferentially spaced on the first opposing surface, the driven side member includes a second plurality of cam teeth circumferentially spaced on the second opposing surface, each of the first plurality of cam teeth includes a first forward meshing surface and a first reverse meshing surface, each of the second plurality of cam teeth includes a second forward meshing surface and a second reverse meshing surface, the driving side member and the driven side member are configured such that:

each of the first forward meshing surface may directly engage with one of the second forward meshing surface when the driving side member is rotated in the forward direction to transmit torque in the forward direction, and each of the first reverse meshing surface may directly engage with one of the second reverse meshing surface when the driving side member is rotated in the reverse direction to transmit the torque in the reverse direction, one member of the driving side member and the driven side member is (i) movable in the axial direction with respect to a second member of the driving side member and the driven side member and (ii) biased toward the second member by an elastic member, the driving side member, the driven side member and the elastic member are configured to form a torque limiter that disengages the engagement of the first forward meshing surface and the second forward meshing surface or the first reverse meshing surface and the second reverse meshing surface by moving the one member in a separation direction from the second member when load of the driven side member increases, and the first forward meshing surface and the second forward meshing surface have a common first lead angle, the first reverse meshing surface and the second reverse meshing surface have a common second lead angle, and the common first lead angle is different from the common second lead angle, and the torque limiter, the driving side member and the driven side member are configured such that a transmission torque transmitted from the driving side member to the driven side member is equal between the forward rotation and the reverse rotation.

2. The electric power tool according to claim 1, wherein the common first lead angle is smaller than the common second lead angle, and the reverse meshing surface of the second member has a lift toward the one member that is smaller than a lift of the forward meshing surface of the second member.

3. The electric power tool according to claim 1, further comprising a final output shaft on which a bit is mountable, wherein the electric power tool is configured to perform at least one of a rotation operation of the final output shaft and a hammering operation of the bit, the torque limiter is on a torque limiter rotation shaft, and the torque limiter rotation shaft is in a preceding stage of the final output shaft and configured to transmit the torque from the motor to the final output shaft.

4. The electric power tool according to claim 3, further comprising:

a first rotation shaft configured to transmit rotation to the final output shaft; and a second rotation shaft for the hammering operation of the bit, wherein the torque limiter rotation shaft is the first rotation shaft.

5. The electric power tool according to claim 1, wherein the plurality of cam teeth of the second member has a lift toward the one member such that an amount of the lift decreases by inclining an opposed surface to the one member in a direction of separating from the one member as heading from the a side in a forward rotation direction toward a side in a reverse rotation direction.

6. The electric power tool according to claim 5, wherein an inclination of the opposed surface begins at a center of the opposed surface in a rotation direction.

7. The electric power tool according to claim 5, wherein an inclination of the opposed surface has a planar surface.

8. The electric power tool according to claim 3, wherein the driving side member and the driven side member have sleeve shapes externally mounted on the torque limiter rotation shaft.

9. The electric power tool according to claim 8, wherein the elastic member is a coil spring externally mounted on the rotation shaft.

10. The electric power tool according to claim 8, wherein a grease pool depression is in at least one of an inner peripheral surface of the one member and an outer peripheral surface of the torque limiter rotation shaft.

11. The electric power tool according to claim 10, wherein the grease pool depression is a ring-shaped groove in the outer peripheral surface of the torque limiter rotation shaft.

12. The electric power tool according to claim 10, wherein the grease pool depression is a ring-shaped groove in the inner peripheral surface of the one member.

13. The electric power tool according to claim 8, further comprising:

a receiving member that (i) receives the second member when the second member is pushed by the one member in the axial direction and (ii) is externally and integrally mounted on the torque limiter rotation shaft in the rotation direction; and a plurality of washers stacked and interposed between the second member and the receiving member in the axial direction.

14. The electric power tool according to claim 8, further comprising a gear externally mounted on the torque limiter rotation shaft, a rotation of the motor being transmitted to the gear, wherein the driving side member includes a clutch movable in the axial direction and rotatable integrally with the driving side member, the clutch is movable to a first position and a second position by a switching operation of a plurality of predetermined operation modes, and the clutch, the gear and the driving side member are configured such that the clutch (i) engages the gear to transmit a rotation of the gear to the driving side member at the first position and (ii) separates from the gear and does not transmit the rotation of the gear to the driving side member at the second position.

* * * * *